United States Patent [19]

Samuel et al.

[11] 4,324,212

[45] Apr. 13, 1982

[54] COMPRESSED AIR STARTER

[75] Inventors: Olof Samuel, Saltsjö-Boo, Sweden; Heikki Hellemaa, Abo, Finland

[73] Assignees: Rederiaktiebolaget Nordstjernan, Stockholm, Sweden; Oy Wartsila AB, Abo, Finland

[21] Appl. No.: 174,792

[22] PCT Filed: Apr. 10, 1979

[86] PCT No.: PCT/SE79/00086

§ 371 Date: Dec. 11, 1979

§ 102(e) Date: Dec. 5, 1979

[87] PCT Pub. No.: WO79/00917

PCT Pub. Date: Nov. 15, 1979

[30] Foreign Application Priority Data

Apr. 11, 1978 [SE] Sweden ..... 7804073

[51] Int. Cl.[3] ..... F02N 17/08

[52] U.S. Cl. ..... 123/179 F; 60/627

[58] Field of Search ..... 123/179 F, 414; 60/625, 60/627

[56] References Cited

U.S. PATENT DOCUMENTS

| | | | |
|---|---|---|---|
| 2,595,281 | 5/1952 | Miller | 60/627 |
| 3,032,965 | 5/1962 | Wistner | 123/179 F |
| 3,307,349 | 3/1967 | Brelen | 123/179 F |
| 4,112,895 | 9/1978 | Habert | 123/414 |

FOREIGN PATENT DOCUMENTS

| | | | |
|---|---|---|---|
| 1210244 | 2/1966 | Fed. Rep. of Germany | 123/179 F |
| 236801 | 7/1925 | United Kingdom | 60/627 |
| 481709 | 11/1975 | U.S.S.R. | 123/179 F |

*Primary Examiner*—P. S. Lall

*Attorney, Agent, or Firm*—Holman & Stern

[57] ABSTRACT

This invention relates to a compressed air starter including pneumatically operating starting valves for diesel engines, wherein one main starting valve is connected to the cylinder head of the engine and is provided with a valve body, which co-operates with a valve seat in order to alternately open and close an inlet opening for compressed air to one cylinder, whereby during the start up of the engine, starting air (compressed air) continuously is supplied to the main starting valve, said valve body including one servo piston, which is controlled by servo air from a supply of servo air, which servo air acts on the servo piston during moments related to the working phase of the engine.

The invention simplifies the pipe arrangement for the compressed air in a diesel engine with several cylinders where there is usually arranged a main distributor for distributing the servo or pilot air, which controls the starting valves. The invention utilizes a magnetic valve (17), which is connected to the main starting valve (8,9,10) and has a valve slide, which in one position (I–II) connects the supply (16) of servo air with a compression face of the servo valve (10), said servo valve thereby being activated to drive the valve body (8,9) to the opening position and, in a second position (II–III) controls the outlet from the supply (16) of servo air so that the servo piston drives the valve body (8,9) to a closing position, said magnetic valve (17) being controlled by electric signals from a transmitter (20) controlled by the crank shaft or by a second shaft (22) rotating in accordance with the working phase of the engine.

9 Claims, 2 Drawing Figures

COMPRESSED AIR STARTER

BRIEF SUMMARY OF THE INVENTION

This invention relates to a compressed air starter including pneumatically operating starting valves for diesel engines, wherein one main starting valve connected to the cylinder head of the engine is provided with a valve body, which co-operates with a valve seat in order to alternatively open and close an inlet opening for compressed air to one cylinder, whereby during the start up of the engine, starting air (compressed air) continuously is supplied to the main starting valve. Valve body has one servo piston, which is controlled by servo air from a supply of servo air in correlation with the working phase of the engine.

The object of the invention is to simplify the pipe arrangement for the compressed air of a diesel engine with several cylinders where there is usually arranged a main distributor for distributing the servo or pilot air, which controls the starting valves. In ordinary arrangements the piping must be doubled because of a need of separate pipes for the compressed air and the servo air. By this invention it is possible to reduce the length and the amount of pipes so that it only will be necessary to have a short branch pipe for taking the servo air from the main piping for the compressed air and this branch pipe is branched closely to the starting valve of each cylinder. It is also possible to achieve a more secure and more simple control of the starting procedure, which also applies for reversing the engine. The invention will also simplify the possibility of braking the engine with compressed air in the event that the engine must be stopped for reversed driving direction, which means that when the invention is used with a diesel engine for a ship the braking distance of the ship will be very much reduced. The invention is characterized by a magnetic valve that is connected to the main starting valve and has a valve slide, which in one position connects the supply of servo air with a compression face of the servo valve, said servo valve thereby being activated to open and in a second position controls the outlet from the supply of servo air so that the servo piston drives to close the servo valve. The magnetic valve is controlled led by electric signals from a transmitter controlled by a correlation with the crank shaft, or by an axis rotating in accordance with the working phase of the engine, i.e. a shaft rotating synchroneously with the crank shaft.

According to another embodiment of the invention the outlet from the supply of servo air is closed in said second position of the valve slide and the pressure face of the servo piston is released of pressure. By this embodiment the piping is more simplified over the embodiment stated in claim 1.

According to a third embodiment of the invention the supply of servo air is connected with the opposite side of the servo piston in said second position of the valve slide. The movement of the servo piston will thereby be controlled distinctly by the servo air instead of for instance the return stroke of the servo piston being carried out by means of a compression spring.

According to still another embodiment of the invention the electric signals are produced by a capacitive transmitter placed in front of a sector formed plate, which is mounted on an axis, whereby the relative position of said sector and its size of angle determines the moment of generation of the signal and its length (duration). The signals in this way will give a very reliable function with great possibilities to so adapt the servo air that it acts on the servo piston in the precise moment and with a length of time which is exactly long enough. The relevant parameters are the size of the sector and also its rotating time in relation to the crank shaft. The relative position of the plate may easily be adjusted and moreover it is possible to construct the sector formed plate so that its angle may be varied or adjusted. Components of these kinds are very reliable in their operation and can stand vibrations and shocks.

In the case of several cylinders, which is most common, there is one capacitive transmitter for each magnet valve. Alternatively, one single transmitter may be used, which is connected to each one of the magnetic valves via an electric distributor, which means that it is only necessary to arrange one capacitive transmitter for each engine.

BRIEF DESCRIPTION OF THE DRAWINGS

An embodiment of the invention will now be described with reference to the enclosed drawings.

DETAILED DESCRIPTION

Figure 1:
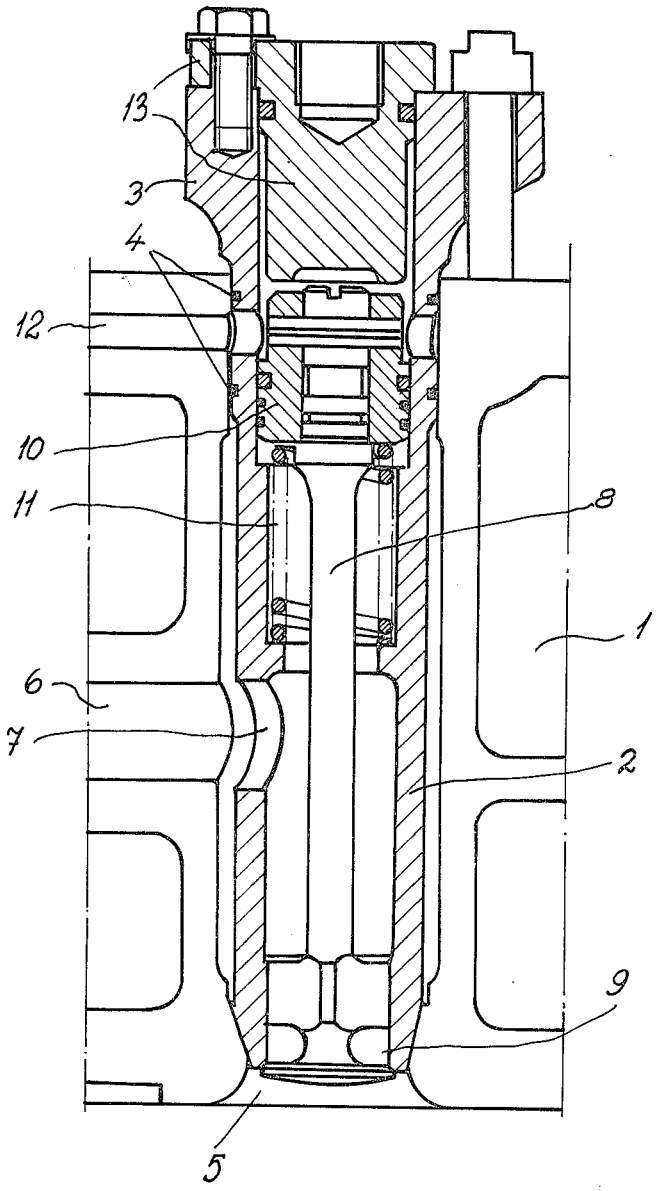
FIG. 1 is thereby a cross-sectional view of a part of a cylinder head in which there is installed a main starting valve of known type.

With reference to FIG. 1 there is shown a cylinder head 1 of a normal diesel engine. A main starting valve generally designated 2 is placed in the cylinder head. The main starting valve is of a known type but shall be briefly described. It includes a sleeve 3, which is inserted in a hole through the cylinder head 1 with a close fit to the inner surface of the hole, for instance by seal rings 4. The sleeve 3 also has at its lower end a close fit in a hole 5, which opens into the top of the cylinder. Starting air under high pressure is inserted through a channel 6 in the head 1 and an inlet 7 into the interior of the sleeve. Within the sleeve there is a valve body including a shaft 8 and a valve disc 9. The compressed air, which enters the sleeve 3, can pass out through the opening 5 when the valve disc 9 opens the corresponding opening in the lower end of the sleeve. The shaft 8 is at the upper end connected to a servo piston 10, which is forced upwards by a compression spring 11. A space within the sleeve is provided above the servo piston 10 and the servo air is inserted to that space through a channel 12 in the head 1. The upper open end of the sleeve 3 is closed by a sealing cap 13 held in place by bolts.

The operation of the main starting valve is as follows: Starting air or compressed air is supplied continuously during the starting procedure of the engine through the channel 6 but the valve body will not be affected to move in any direction because the pressures on the starting valve are balanced by equal areas of the servo pistons 10 and the valve disc 9. Further, the compression spring 11 acts upwards preventing the valve disc 9 from being moved downwardly to its opening position. When servo air is supplied via the channel 12 to the upper end of the servo piston, the pressure balancing will cease and the valve shaft 8 with the valve disc 9 will be quickly moved downwards, so that the main starting valve is opened and starting air or compressed air may pass from channel 6 through the inlet 7 and through the inner space of the sleeve 3 and over the valve disc 9 through the opening 5 into the upper end of the cylinder. The engine piston (not shown) will thereby be pressed downwards from its initial top position whereby the engine will start running.

Figure 2:
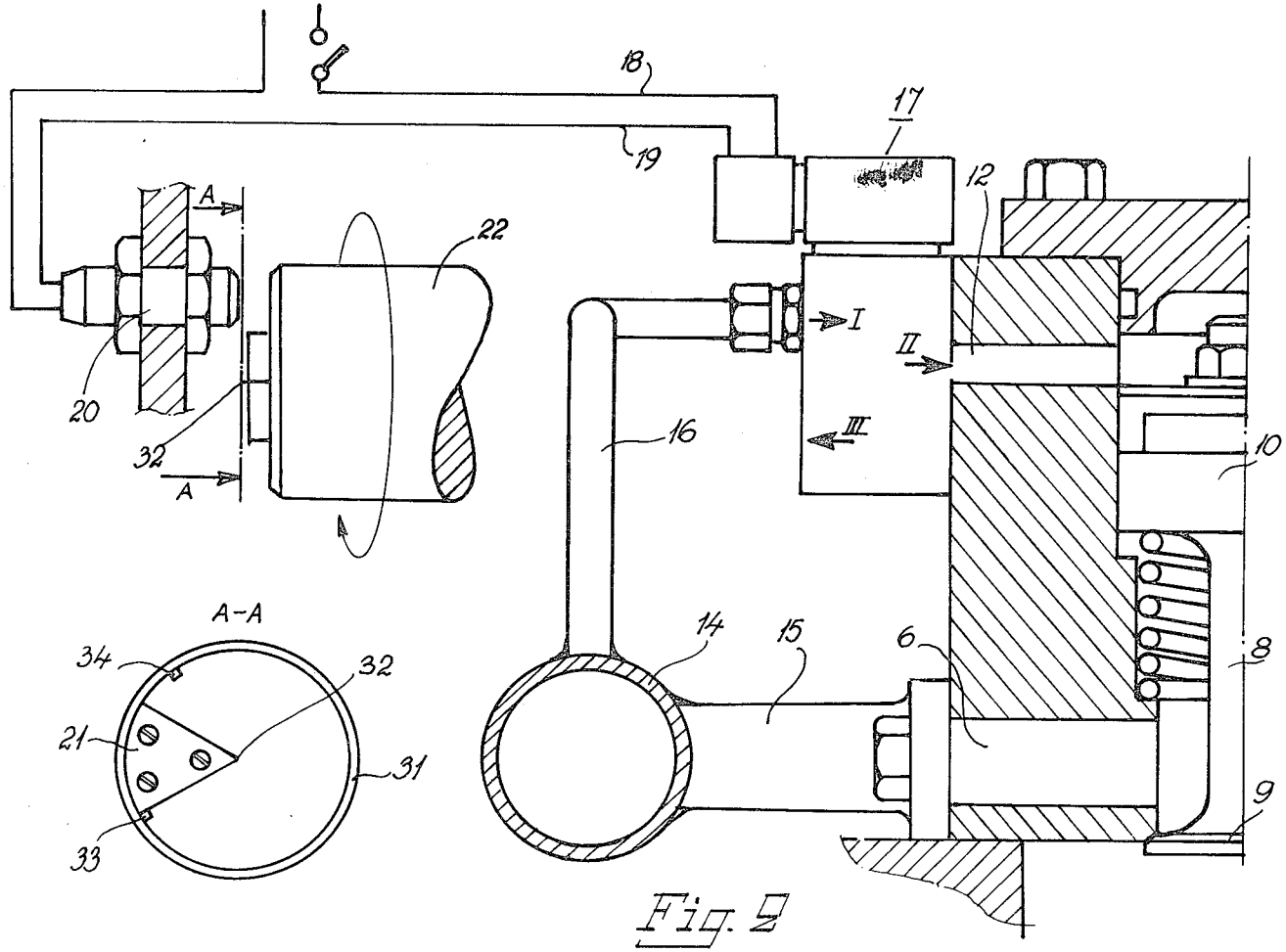
FIG. 2 is a partly diagramatic cross-sectional view of a starting valve including a servo piston showing an embodiment of the invention mounted on the valve house of the starting valve. The impulse transmitter and the piping are shown diagramatically.

An embodiment of the invention will now be described with reference to FIG. 2. FIG. 2 shows, at the right side, a section through a part of a cylinder head with its main starting valve, wherein 8 designates the shaft of the valve, 9 designates its valve disc and 10 designates the servo piston. There are also the inlet channel 6 for the starting air for compressed air and an inlet channel 12 for the servo air. The starting air is supplied to channel 6 from a supply pipe 14, which has a branch pipe 15 leading to the channel 6. Connected to the supply pipe 14 there is a second branch pipe 16, from which the servo air is passed in order to control the servo piston 10 via the channel 12. The control of supply of servo air is carried out by a magnet valve, which is generally designated at 17. The magnet valve has a slide (not shown), which has two end positions so that in one of these end positions the two ports designated with the arrows I and II are connected, whereby the supply of servo air to channel 12 is carried out, and in the second end position, the ports designated with the arrows II and III are connected, whereby channel 12 is vented and the port at the arrow I is closed. The slide of the magnet valve 17 is controlled according to the working phase of the cylinder to which the main starting valve 8, 9 and 10 belongs. The control of the magnet valve 17 is carried out by electric pulses, which are supplied by a circuit, which includes the leads 18 and 19.

The pulses are supplied by a capacitive transmitter 20, which is placed in front of a sector formed plate 21, which is fastened on a shaft 22 which is at right angles to the plate and which is rotating in time relation to the rotation of the crank shaft. The capacitive transmitter is mounted eccentrically in relation to the central axis of shaft 22 and thus also eccentrically in relation to the centre of rotation of the sector formed plate 21. The form of the sector is shown in FIG. 2 by the section A—A. The sector formed plate 21 is mounted in a ring 31 which is suspended by a stubb shaft via spokes (not shown). The ring 31 has a peripheral groove, in which the sector formed plate 21 is mounted. The stubb shaft 32 and thus the ring 31 is rotated with shaft 22. In order to drive the plate 21 in the rotational movement of the ring, a shoulder 33 is placed in the groove of the ring. The position of the shoulder 33 thus determines the relative position of the sector formed plate in relation to the angular position of the crank shaft and in relation to the position of the capacitive transmitter 20. The capacitive transmitter produces an electric pulse when the sector formed plate is in front of the transmitter but as soon as the plate has passed, the electric pulse, or signal, will cease. The supplied electric signal operates the magnetic valve 17, which adjusts the slide so that the ports at the arrows I and II are connected and thus servo air is supplied from the branch pipe 16 via channel 12 to the upper end of the servo piston 10. Thereby the valve disc 9 is opened and starting air is inserted in to the cylinder of the engine. When the piston of said cylinder has reached its bottom dead centre, the sector formed plate 21 will pass over the transmitter 20, whereby the electric signal ceases. This means that the magnetic valve 17 will be in a different position where its slide closes the connection between the ports at the arrows I and II and opens a connection between the ports at the arrows II and III, whereby the pressure is released above the servo piston 10, the main starting valve is closed and the supply of starting air is cut off.

When the engine is started in reversed direction (backward motion) the magnet valve 17 will open for supply of servo air at another angular position of the crank shaft (known per se). The correct position of the sector formed plate 21 in relation to the angular position of the crank shaft is controlled by a second shoulder 34 mounted on the other side of the sector plate in the peripheral groove of the ring 31. This shoulder 34 will drive the plate during the reverse motion, so that the electric signal is produced during a different moment than that which applies to forward motion of the engine.

When the engine has several cylinders, the same number of transmitters 20 are mounted in front of the rotation area of the sector formed plate 21. Alternatively, one transmitter may be used, whereby, however, the number of revolutions of the sector formed plate must be higher in relation to the number of cylinders. It is also necessary to consider whether the engine is a two-stroke cycle engine or a four-stroke cycle engine. Thus, if one transmitter is used for several cylinders, a distributor must be used for distribution of the electric signals from this one transmitter and such a distributor is known per se and used with the usual Otto-cycle machines.

As can be seen from the above description, one magnet valve is mounted to each main starting valve and only a short pipe 16 will be necessary to supply servo air to the servo valve and control it. It, thus, will be unnecessary to have two different pipings along for the air as is taught by the known art. In FIG. 2 there is shown only schematically a magnet valve, but it is of known type and it shall be noted, that there are many different types which can be used. The specific construction of the magnet valve may be dependent on the type of main starting valve to be used and the operation and the form of the servo piston 10. Thus, in the shown embodiment, one side of the servo piston is pressurized when the servo piston is to be moved in one direction and the pressure is released from this side of the piston during its return stroke. However, it is possible, in an alternative embodiment, that one side of the servo piston is pressurized for carrying out the motion in one direction whereas the other side of the piston is pressurized for performing the return stroke of the servo piston. If so, a different type of slide of the magnetic valve 17 must be used than the one schematically shown and described above.

Further, it is possible within the scope of the invention to use an alternative form of signal to be supplied to the magnet valve.

Thus, it is possible to use an impressed voltage on the magnet valve to keep it in one of the two positions, while the magnet valve will shift to its second position when the voltage is null. This control may be carried out by switches of known type which are controlled to operate according to the working phase of the engine. Also, it is possible to control the signal by a photo-cell.

When starting up for reversed motion of the engine, it is possible to alter the signals by changing the order between the signal transmitter and the cylinders and this can be accomplished by an electric switching means between the transmitters and the magnet valve. This means that a signal from one transmitter will reach the magnet valve of for instance a fifth cylinder instead of the magnet valve of the first cylinder.

We claim:

1. In a compressed air starter for diesel engines wherein a main starting valve is operably arranged in a cylinder head and includes a valve body, which cooperates with a valve seat for opening and closing an inlet for compressed air to the cylinder of the engine, compressed air during the starting operation continuously is supplied to the main starting valve and the valve body has a servo piston, which is controlled by servo air from a supply thereof through a servo supply channel, which servo air acts on the servo piston in correlation with the working phase of the engine, the improvement comprising a magnetic valve operatively connected in the servo supply channel to the main starting valve, said magnetic valve having a valve slide, which in one position connects the supply of servo air with one side of the servo piston to drive the valve body to open the inlet for compressed air to the cylinder, and which valve slide in a second position controls the supply of servo air so that the servo piston drives the valve body to close said inlet, and a transmitter controlled by means in synchronization with the engine crank shaft to emit electrical signals in response to the rotation thereof, said transmitter being operatively connected to said magnetic valve so that said electrical signals control said valve.

2. Improvement according to claim 1, wherein said magnetic valve closes the supply of servo air and opens the pressure side of the servo piston to vent the same in said second position of the valve slide.

3. Improvement according to claim 1, wherein means are provided to connect said supply of servo air with the opposite side of the servo piston when said magnetic valve slide is in said second position.

4. Improvement according to claim 1, wherein said transmitter is a capacitive transmitter, and further comprising a sector formed plate mounted on a rotatable shaft synchronized with said crank shaft and rotates therewith whereby the angular position of the sector and the size of the angle included therein determines the moment of generation of the signal and its duration.

5. Improvement according to claim 4, wherein the engine includes several cylinders and further comprising one said capacitive transmitter and one said magnetic valve is provided for each starting valve and said transmitters are mounted along a circular path in front of the rotating plane of the sector formed plate.

6. Improvement according to claim 4, wherein the engine has several cylinders, and a magnetic valve is provided for each starting valve and said capacitive transmitter is connected with each magnetic valve via an electric distributor.

7. Improvement according to claim 4, wherein said sector formed plate is mounted freely rotating in a ring in its plane and concentric thereto, said ring being mounted on said rotatable shaft and having at least one shoulder, which drives the sector formed plate in at least one direction of rotation.

8. Improvement according to claim 7, wherein said ring has a second shoulder, which drives the sector formed plate in an opposite direction of rotation and which shoulder is so positioned, that the sector formed plate will have a position in relation to the angular position of the crank shaft, which position corresponds to reversed motion of the engine.

9. Improvement according to claim 1, wherein each said electric signal is an impressed voltage, which is changed in time and duration by a switching means, which is controlled in relation to the working phase of the crank shaft.

* * * * *